United States Patent [19]

Bishop et al.

[11] 4,439,167

[45] Mar. 27, 1984

[54] SHOCK ABSORBER ASSEMBLY

[75] Inventors: Thomas R. Bishop; Archie W. Peil, both of Houston; Wayne A. Kovar, Missouri City; Roger D. Chancey, Humble, all of Tex.

[73] Assignee: Bowen Tools, Inc., Houston, Tex.

[21] Appl. No.: 353,624

[22] Filed: Mar. 1, 1982

[51] Int. Cl.[3] ..... E21B 17/00

[52] U.S. Cl. ..... 464/20; 175/321; 267/125

[58] Field of Search ..... 464/18, 20, 180, 183; 175/321; 267/125, 137

[56] References Cited

U.S. PATENT DOCUMENTS

| | | | |
|---|---|---|---|
| 2,025,100 | 12/1935 | Gill et al. | 464/18 |
| 2,240,519 | 5/1941 | Reed | 175/321 |
| 2,520,306 | 8/1950 | Detweiler | 277/176 |
| 2,712,435 | 7/1955 | Allen | 267/137 |
| 2,987,129 | 6/1961 | Webb | 464/18 X |
| 3,033,011 | 5/1962 | Garrett | 464/20 |
| 3,225,566 | 12/1965 | Leathers | 464/18 |
| 3,281,166 | 10/1966 | Doughty, Jr. et al. | 175/321 X |
| 3,350,900 | 11/1967 | Harrison | 464/18 |
| 3,370,657 | 2/1968 | Antle | 175/321 X |
| 3,606,297 | 9/1971 | Webb | 267/125 |
| 3,735,828 | 5/1973 | Berryman | 175/321 X |
| 3,750,423 | 8/1973 | Williams | 267/137 X |
| 3,815,692 | 6/1974 | Varley | 175/321 X |
| 3,947,008 | 3/1976 | Mullins | 267/125 X |
| 3,949,150 | 4/1976 | Mason et al. | 175/321 |
| 3,998,443 | 12/1976 | Webb | 267/125 |
| 4,031,716 | 6/1977 | Zabcik | 175/321 X |
| 4,055,338 | 10/1977 | Dyer | 267/125 |
| 4,067,405 | 1/1978 | Bassinger | 175/321 |
| 4,130,000 | 12/1978 | Burge | 267/125 X |
| 4,133,516 | 1/1979 | Jürgens | 267/125 |
| 4,145,034 | 3/1979 | Dyer | 267/125 |
| 4,171,025 | 10/1979 | Bassinger | 175/321 X |
| 4,331,006 | 5/1982 | Bishop | 267/125 X |

*Primary Examiner*—Stuart S. Levy
*Assistant Examiner*—Daniel P. Stodola
*Attorney, Agent, or Firm*—Pravel, Gambrell, Hewitt, Kirk & Kimball

[57] ABSTRACT

A shock absorber assembly adapted to be used with a drill string dampening intermittent shocks and vibrational forces encountered with a drill string, the shock absorber assembly including a mandrel, a tubular body reciprocally mounted with respect to the mandrel, and a dampening device including an annular chamber adapted to be filled with a compressible fluid and a flexible wall with the mandrel adjacent the annular chamber for permitting flexure of the mandrel as needed for dampening.

7 Claims, 6 Drawing Figures

SHOCK ABSORBER ASSEMBLY

TECHNICAL FIELD OF THE INVENTION

The technical field of this invention relates to devices used in the absorption of intermittent shocks and vibrations, particularly of the type used in conjunction with a drill string during drilling operations.

DESCRIPTION OF THE PRIOR ART

Shock absorbing devices have long been used in the rotary well drilling industry for reducing shocks and vibrations encounted by the drilling bit during drilling operations while penetrating through rock formations having varying, inconsistent layers. In an effort to reduce the shocks and vibrations, many types of shock absorbing devices have been used. Some devices utilize springs for isolating such shocks between two movable members such as disclosed in U.S. Pat. Nos. 3,281,166 and 4,133,516. Other devices include the use of resilient rubber pads for attempting to isolate such shocks as shown in U.S. Pat. Nos. 3,949,150 and 4,130,000. U.S. Pat. No. 2,712,435 uses a combination of springs and fluid cavities to effectuate the desired shock absorbing function.

Other techniques have incorporated what is known as a "floating piston" design such as disclosed in U.S. Pat. Nos. 3,606,297; 3,815,692; 4,031,716; 4,055,338; 4,067,405; 4,145,304; and 4,171.025. U.S. Pat. No. 3,998,443 discloses a multidirectional shock absorbing device while U.S. Pat. No. 3,350,900 utilizes a differential area concept in order to effectuate shock cushioning of a rotary driving well tool.

Furthermore, U.S. Pat. No. 3,225,566 discloses a drill string shock absorber utilizing an annular piston adapted to move within an annular chamber that is filled with a compressible fluid, with the action of the annular piston against the compressible fluid providing the dampening force for effectuating the shock absorber function. However, this tool, as well as others noted above depend upon dampening being the resultant of one primary mechanism, be it internal spring arrangements, and/or fluid cushioning arrangements. So far as known, none of the prior art incorporates a concept wherein the dampening of the shock absorber assembly is a function of both the compressibility of a fluid within an annular chamber within the tool in combination with a calculated, required flexing of the shock absorber assembly itself under high loads in order to effectuate dampening of the shock absorber tool.

Other prior art difficulties have included shock absorber assemblies having reciprocating mandrels wherein the smallest portion of the mandrel is adjacent the uppermost portion of the tool which results in two problems: first, the seals adjacent the upper end of the mandrel have inherent tendency to collect sand adjacent thereto which causes accelerated deterioration of not only the seals themselves but the adjacent bore surfaces necessary for proper sealing (as per the seals 70 of U.S. Pat. No. 3,225,566 by way of example). Secondly, due to this prior art arrangement, bearings (such as bearings 116 of U.S. Pat. No. 3,225,566) must necessarily be placed adjacent the lower end of the shock absorber assembly which may result in wallowing or of lateral displacement of the shock absorber assembly preventing properly aligned drilling during use of the shock absorber assembly with the drill string. So far as known, no prior art shock absorber assembly is capable of resolving all such difficulties yet is further capable of being easily serviced and maintained.

SUMMARY OF THE INVENTION

The present invention relates to a new improved shock absorber assembly wherein the shock absorber assembly includes an elongated tubular body having an open upper end for receiving a mandrel therewith for longitudinal reciprocal movement with respect thereto, with dampening means including a longitudinally extending annular chamber and flex means therewith, the annular chamber adapted to be filled with a compressible fluid and the flex means permitting flexure of the mandrel as needed whereby the intermittent shock and vibrational forces may be dampened by the shock absorber assembly of the present invention.

DESCRIPTION OF THE PREFERRED EMBODIMENT

Figure 1:
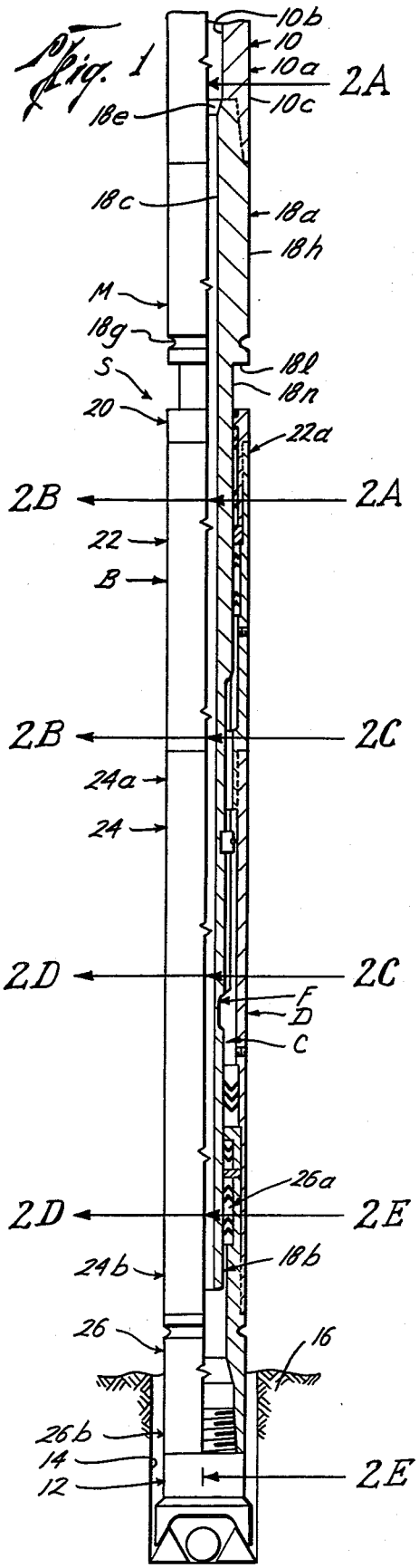
FIG. 1 is an elevational view of the shock absorber assembly of the present invention as schematically used with a drill string, with the shock absorber assembly being positioned in a typically normal operational mode.

Referring to the drawings, the shock absorber assembly of the present invention is referred to generally by the letter S. The shock absorber assembly S is adapted to be used with a drill string such as drill string 10 (FIG. 1) and preferably is positioned between the lower end 10*a* of the drill string 10 and drill bit 12. The drill bit 12, preferably capable of providing cutting action upon rotation and axial loading thereof, is typically utilized for drilling a suitable well bore 14 in geologic formations 16. The shock absorber assembly S may also be positioned at various other locations in the drill string 10 as is necessary to effectuate appropriate shock absorption functions as is deemed necessary under varying conditions. The shock absorber assembly S generally includes a mandrel M, an elongate tubular body B mounted for reciprocal movement with respect to the mandrel M and dampening means D including generally a longitudinally extending annular chamber C and flex means F. Unless otherwise noted, it is preferred that the components of this invention be made of suitable high strength materials such as steel or other high grade materials capable of withstanding the significant stresses and strains encountered during typical drilling operations.

Figure 2A:
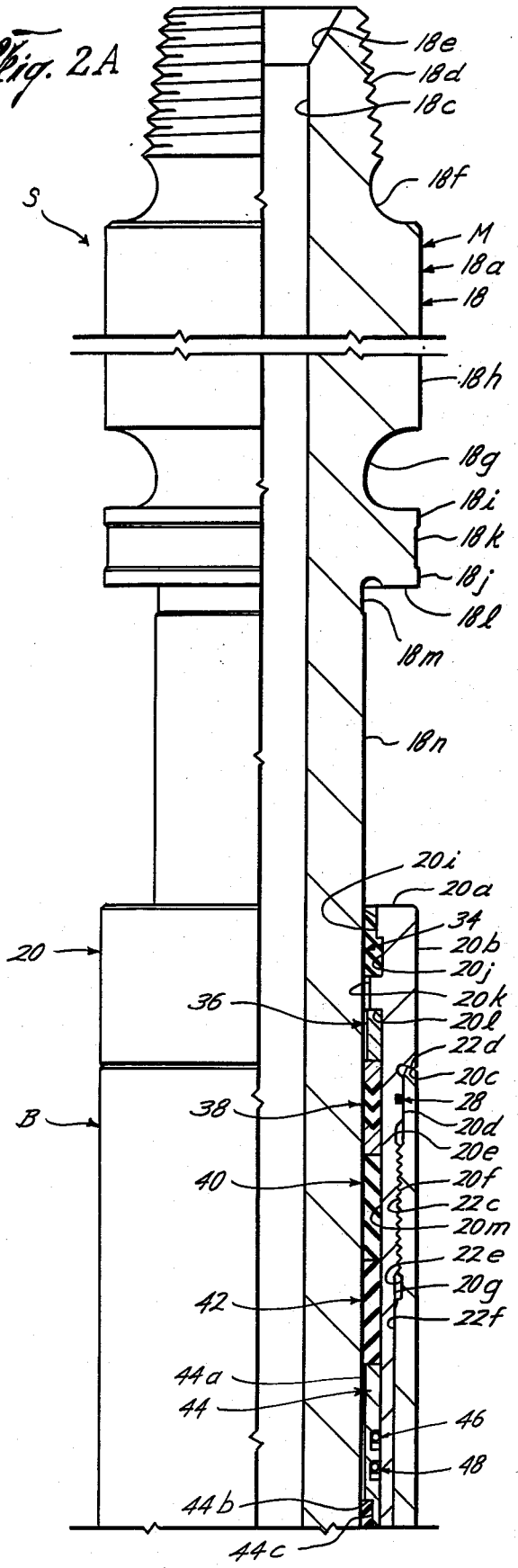
FIG. 2A is an elevational, sectional view of the shock absorber assembly of the present invention as taken along the lines 2A—2A of FIG. 1.

The shock absorber assembly S of the present invention includes a mandrel M adapted to be mounted with the lower end 10*a* of the drill string 10. The mandrel M includes a mandrel 18 including an upper end 18*a* (FIGS. 1, 2A) and lower end 18*b* (FIGS. 1, 2E). The mandrel 18 is preferably formed of a general tubular configuration having a longitudinally extending bore 18*c* that extends along the entire length of the mandrel 18 from the upper end 18*a* to the lower end 18*b* and is of substantially the same diameter along its entire length. The diameter of the bore 18*c* may be of the same diameter as that of the bore 10*b* of the drill string 10, or as shown in FIG. 1, may be of a lesser diameter or any other suitable diameter as may be desired.

The mandrel 18 is preferably formed having suitable threads 18*d* formed adjacent the upper end 18*a* thereof. A suitable conical surface 18*e* is formed adjacent thread 18*d* to permit ease of transition between bore 10*b* of the drill string 10 and bore 18*c* of mandrel 18 so as not to restrict the flow of drilling fluid and the like that is typically used within a drill string 10 utilizing the shock absorber assembly S of the present invention.

Suitable detents 18*f*, 18*g* may be formed with the mandrel 18 adjacent the upper end 18*a* to provide necessary stress relief and overall weight reduction of the shock absorber assembly S of the present invention. It is preferred that outer annular surface 18*h* be of a diameter similar to that of the outer annular surface 10*c* of the drill string 10, as are outer annular surfaces 18*i*, 18*j* of the mandrel 18. A suitable detent 18*k* may be formed between the outer annular surfaces 18*i*, 18*j*. A radial surface 18*k* is preferably formed adjacent to outer annular surface 18*j*, with a stress relief detent 18*m* formed between the radial surface 181 and annular surface 18*n*.

Preferably, the annular surface 18*n* is longitudinally extending and extends from substantially the radial surface 181 downwardly to conical surface 18*o* (FIG. 2B) surface 18*o* terminates in segmented annular surface 18*p* forming a plurality of longitudinally extending splines 18*q* having a maximum diameter defined by the annular surface 18*p* and a minimum spline depth as shown by the surface 18*r*. It is preferred that the splines 18*q* be of a generally rectangular configuration in cross-section; however, any other suitable cross-sectional configuration may be used. Preferably, the splines 18*q* are disposed annularly about the bore 18*c* of the mandrel 18. The longitudinally extending splines 18*q* along with their compatibly formed segmented annular surface 18*p* terminate at a shaped surface 18*s* (FIG. 2D). The splines 18*q* are formed having radial surfaces 18*t*, 18*u* (FIG. 2C) formed between and intermediate of the conical surface 18*o* and shaped surface 18*s*.

An annular surface 18*v* is formed between the radial surfaces 18*t*, 18*u* as described more fully hereinbelow. Preferably, the annular surface 18*v* is of a lesser diameter than that of the surface 18*r*. The shaped surface 18*s* merges with annular detent 18*w* which is formed adjacent to annular surface 18*x*. Preferably, surfaces 18*r*, 18*x* are of substantially the same outside diameter, with the diameter of annular detent 18*w* being less than that of surfaces 18*r*, 18*x* but greater than that of the bore 18*c* as discussed more fully hereinbelow. The annular surface 18*x* extends to the lower end 18*b* of the mandrel 18 of the mandrel M where a tapered surface 18*y* is formed adjacent to end surface 18*z*.

The shock absorber assembly S of the present invention further includes a body B including a mandrel body 20, a spline body 22, middle body 24 and bottom sub 26. The mandrel body 20 of the body B includes an upper end surface 20*a* and an outer annular surface 20*b*. Surface 20*b* has preferably the same diameter as that of annular surfaces 18*h*, 18*i* and 18*j* of the mandrel 18 of the mandrel M. An abutting surface 20*c* is formed adjacent the outer annular surface 20*b*, with a suitable annular surface 20*d* formed adjacent thereto and adapted to receive suitable seal means 28 therewith. Preferably, a stress relief detent 20*e* is formed adjacent to annular surface 20*d* with threads 20*f* formed adjacent thereto. Lower annular surface 20*g* is formed beneath the threads 20*f* and extends downwardly to end surface 20*h* and is adapted to receive seal means 30, 32 therewith. Preferably, the mandrel body 20 further includes an inner annular surface 20*i* adjacent the upper end surface 20*a* and adjacent to annular surface 20*j* which, in turn is formed adjacent to inner annular surface 20*k*. Inner annular surface 20*k* terminates at radial surface 201 with annular surface 20*m* extending downwardly from radial surface 201 to end surface 20*h* of the mandrel body 20. Preferably, the annular surfaces 20*i*, 20*j* are adapted to receive mandrel body wiper 34 which is adapted to sealably engage the annular surface 18*n* of mandrel 18.

A packing retainer 36 is preferably mounted in abutting relation with the radial surface 201 and annular surface 20*m*, with suitable packing 38 disposed between the packing retainer 36 and mandrel body bearings 40, 42. The mandrel body bearings 40, 42 are adapted to be disposed between the annular surface 18*n* of the mandrel 18 and the annular surface 20*m* of mandrel body 20 for preventing lateral displacement, wallowing, and/or misaligned drilling in the use of the shock absorber assembly S of the present invention as discussed more fully hereinbelow. A packing support 44 is mounted in abutting relation to the mandrel body bearing 42, with the packing support 44 being disposed between the annular surfaces 18*n*, 20*m*. The packing support 44 provides a suitable detent for seal means 46, 48 which is adapted to be disposed between the packing support 44 and the annular surface 20*m* of the mandrel body 20. It is preferred that the bore 44*a* of the packing support 44 be of a diameter slightly greater than that of the annular surface 18*n* to prevent engagement therebetween. Furthermore, the packing support 44 is formed having a radial surface 44*b* and annular surface 44*c* which is adapted to receive packing support bearings 50, 52, with packing set 54 (FIG. 2B) disposed therebetween.

The body B further includes a spline body 22 having an upper end 22*a* and lower end 22*b*. Adjacent the upper end 22*a* suitable threads 22*c* are formed for engagement with compatibly formed threads 20*f*. End surface 22*d* abuts abutting surface 20*c* when the spline body 22 is in proper threaded engagement with the mandrel body 20. Preferably, a suitable detent 22*e*, for stress relief, is formed adjacent to threads 22*c* with annular surface 22*f* formed adjacent to the detent 22*e*. The annular surface 22*f* terminates with radial surface 22*g*, with annular surface 22*h* formed adjacent thereto. Annular surface 22*h* extends downwardly to radial surface 22*i*. Annular surface 22*j* is formed adjacent to radial surface 22*i* and extends downwardly therefrom. The annular surface 22*j* terminates with shaped surface 22*k*. A segmented annular surface 221 is formed adjacent to the shaped surface 22*k*, with suitable, longitudinally extending splines 22*m*, being formed with the segmented annular surface 221. The height of the splines 22*m* are defined as a distance between the segmented annular surface 221 and segmented annular surface 22*n* and is adapted to engage compatibly formed splines 18*q* formed between the segmented annular surfaces 18*p*, 18*r*. As such, interaction between the splines 18*q* of the mandrel 18 and splines 22*m* of the spline body 22 allow reciprocal longitudinal movement between the mandrel 18 and spline body 22 but prevent any relative rotation therebetween, as discussed more fully hereinbelow. The splines 22*m* and surfaces 221, 22*n* terminate at end surface 22*o*. An outer annular surface 22*p* extends upwardly from end surface 22*o* and is formed having suitable detents (not numbered) capable of receiving seal means 56, 58, 60 which is adapted to sealably engage the middle body 24 as discussed more fully hereinbelow.

Threads 22*q* are formed adjacent the outer annular surface 22*p* with a suitable detent 22*r* formed adjacent the upper end of the threads 22*q*, and annular surface 22*s* formed adjacent to the detent 22*r*. Preferably suitable seal means 62 is disposed with the annular surface 22*s* for insuring fluid tight relation between the spline body 22 and middle body 24. Preferably, a suitable abutting surface 22*t* is formed adjacent to annular surface 22*s*. It is preferred that a suitable threaded opening 22 (Fig.2B) be formed with the spline body 22*u* and adapted to receive a suitable threaded fill plug 64 as detailed more fully hereinbelow. Preferably, the spline body 22 also includes an outer annular surface 22*v* which extends between the abutting surface 22*t* upwardly to end surface 22*d* and is of a diameter substantially the same as that of the annular surfaces 20*b*, 18*j*, 18*i*, 18*h*, 10*c*.

Figure 2B:
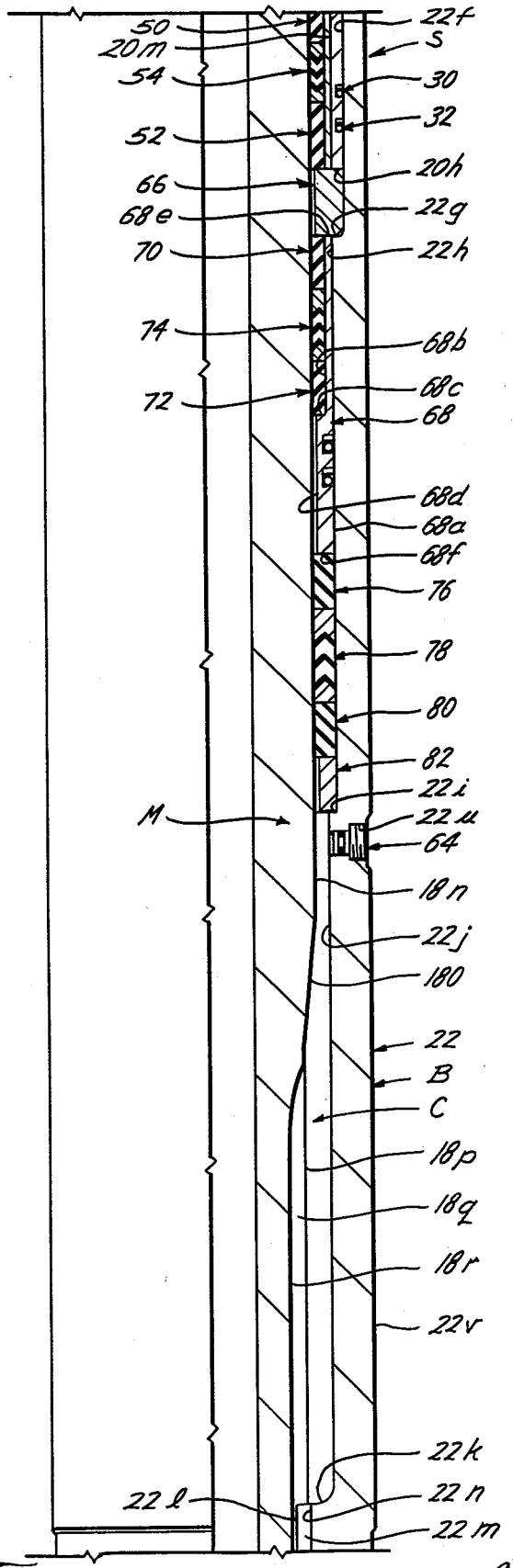
FIG. 2B is an elevational, sectional view of the shock absorber assembly of the present invention as taken along the lines 2B—2B of FIG. 1.

As best seen in FIG. 2B, a packing retainer 66 is preferably disposed between the end surface 20*h* of mandrel body 20, lower end of the packing support 44, packing support bearing 52 and the radial surface 22*g* of the spline body 22. A packing support 68 abuts the packing retainer 66 adjacent its upper end with the outer annular surface 68*a* of the packing support adapted to be disposed compatibly within the annular surface 22*h* of the spline body 22. The annular surface 68*b*, radial surface 68*c* and annular surface 68*d* are formed within the bore of the packing support 68. Thus, end surface 68*e* of the packing support 68 abuts the packing retainer 66. The annular surface 68*b* of the packing support 68 is adapted to receive packing support bearings 70, 72, with a suitable packing means 74 disposed between the packing support bearing 70, 72. The packing support bearing 70, 72 and packing means 74 are disposed within the annular surface 68*b* of the packing support 68 and exterior to the annular surface 18*n* of the mandrel 18. The packing support bearings 70, 72 and packing means 74 preferably have an inner bore substantially identical to that of the diameter of the annular surface 18*n*, while the annular surface 68*d* of the packing support 68 is slightly larger than the diameter of the annular surface 18*n*. The packing support bearing 72 is properly located with the packing support 68 when such is in proper abuttment with the radial surface 68*c* thereof.

Preferably, a packing bearing 76 abuts the lower end surface 68*f* of the packing support 68 with packing means 78, packing bearing 80, and packing retainer 82 disposed adjacent thereto. The packing retainer 82 preferably abuts the radial surface 22*i* and retains the packing bearings 76, 80 and packing means 78 between such packing retainer 82 and the end surface 68*f* of the packing support 68. As noted hereinabove, preferably the inner bores of the packing bearing 76, packing means 78 and packing bearing 80 are substantially identical with the diameter of the annular surface 18*n* for proper engagement therewith and are adapted to be disposed within the annular surface 22*h* of the spline body 22.

The body B of the shock absorber assembly S of the present invention further includes middle body 24. The middle body 24 is formed having an upper end 24*a* and lower end 24*b*. Suitable threads 24*c* are formed adjacent to the upper end 24*a* of the middle body 24 are adapted to compatibly engage threads 22*q* of the spline body 22. A suitable annular surface 24*d* is formed between the threads 24*c* and end surface 24*e* to permit suitable engagement of the seal means 62 between the annular surfaces 22*s* and 24*d*. End surface 24*e* is adapted to be in abutting relationship to the abutting surface 22*t* of the spline body 22 when the middle body 24 is properly threaded with the spline body 22.

The middle body 24 is further formed having an outer annular surface 24*f* of substantially the same diameter as the outer annular surfaces 22*v*, 20*b*, 18*j*, 18*l*, 18*h*, and 10*c*, respectively. The outer annular surface 24*f* terminates in an end surface 24*g* adjacent the lower end 24*b* of the middle body 24. An annular surface 24*h* is formed adjacent to end surface 24*g* with threads 24*i* formed adjacent thereto. Preferably a detent 24*j* is formed adjacent to the upper end of threads 24*i* with annular surface 24*k* extending upwardly from the detent 24*j* to radial surface 241 with annular surface 24*m* extending upwardly from radial surface 241 to radial surface 24*n*. Annular surface 24*o* extends between the radial surface 24*n* and conical surface 24*p*, with annular surface 24*q* extending between the conical surface 24*p* and detent 24*r*. Detent 24*r* is formed adjacent to the lower end of threads 24*c*. The seal means 56, 58, 60 prevent any unwanted fluid migration between the spline body 22 and middle body 24 adjacent surfaces 22*p*, 24*q* respectively, as does seal means 62 between surfaces 22*s*, 24*d*.

The shock absorber assembly S of the present invention includes a middle body packing retainer 84 adapted to be in an abutting relation with the radial surface 24*n*. The outer annular surface of the middle body packing retainer 84 engages the annular surface 24*m*. Similarly, middle body packing bearings 86, 88 locate the middle body packing set 90 between the packing bearings 86, 88. Preferably, the outer annular surfaces of the packing bearings 86, 88 and packing set 90 conform with the annular surface 24*m*, with the inner annular surfaces thereof adapted to engage annular surface 18*x* of mandrel 18. The packing bearing 88 is located in position by the packing support 92 which is adapted to engage radial surface 241 and annular surface 24*k*. The packing support 92 has an annular surface 92*a*, with radial surface 92*b* and annular surface 92*c* formed adjacent thereto. The packing support 92 further includes end surface 92*d* and outer annular surface 92*e* that is adapted to be compatibly disposed within annular surface 24*k*. Packing bearings 94, 96 having packing set 98 therebetween are disposed on surface 92*c* of the packing support 92 and are held in position by suitable packing retainer 100. A bottom sub packing support 102 abuts the packing retainer 100 adjacent upper end 102*a*. Annular surface 102*b* of the packing support 102 is formed adjacent to upper end 102*a* and terminates with radial surface 102*c*. Annular surface 102*d* is formed adjacent to radial surface 102*c* which terminates with end surface 102*e*. Outer annular surface 102*f* extends between the end surface 102*e* and upper end 102*a*. Preferably, packing bearings 104, 106 having packing set 108 positioned therebetween are mounted with the packing support 102 on annular surface 102*b*, with the packing bearing 106 abutting the radial surface 102*c*. Preferably, the inner bores of the packing bearings 104, 106 and packing set 108 are substantially the same as that of the annular surface 18*x* of the mandrel 18. Furthermore, packing bearings 110, 112 are disposed with a packing set 114 therebetween about the annular surface 18*x* and below the packing support 102. A bottom sub packing retainer 116 is mounted adjacent to the packing bearing 112, as discussed more fully hereinbelow. The inner bores of the packing bearings 110, 112 and packing set 114 are substantially the same as that of annular surface 18*x* of the mandrel 18 and are adapted to engage same adjacent the lower end 18*b* of the mandrel 18 of the mandrel M.

The body B of the shock absorber assembly S further includes a bottom sub 26 which is adapted to be in engagement with the middle body 24. The bottom sub 26 includes an upper end 26*a* and a lower end 26*b*. The bottom sub 26 is preferably formed having an upper end surface 26*c* which is adapted to engage packing retainer 100 when in a proper makeup with the middle body 24. The upper end 26*a* of the bottom sub 26 is further formed having an annular surface 26*d* which extends downwardly from the end surface 26*c* to radial surface 26*e*, with annular surface 26*f* extending downwardly from radial surface 26*e*. Annular surface 26*f* terminates at radial surface 26*g*. Annular surface 26*h* is being formed adjacent to radial surface 26*g* and extends downwardly therefrom. Tapered surface 26*i*, is formed adjacent the lower end of annular surface 26*h* with annular surface 26*j* formed adjacent to the tapered surface 26*i*. Preferably, threads 26*k* are formed adjacent the lower end 26*b* of the bottom sub 26 adjacent to the annular surface 26*j* and between end surface 261. Outer annular surface 26*m* extends upwardly from the end surface 261 (as viewed in FIG. 2E) with a suitable stress relief detent 26*n* formed therein between the radial lip 26*o* and annular surface 26*p*. Furthermore, the bottom sub 26 is formed having an annular surface 26*q* adjacent to lip 26*o*, with detent 26*r* formed adjacent thereto and between threads 26*s* and annular surface 26*q*. Preferably, threads 26*s* are adapted to engage the compatibly formed threads 24*i* of the middle body 24. The bottom sub 26 is further has an annular surface 26*t* formed adjacent to threads 26*s* which extends upwardly therefrom until such terminates at end 26*c*. As such, the bottom sub 26 is adapted to be threadedly received with the middle body 24 with compatible threaded action between threads 24*i* and 26*s*. When proper makeup is accomplished, surfaces 24*g* and 26*o* abut with sealing being effectuated by means of seal means 118 (FIG. 2E). Furthermore, sealing is effectuated between the annular surface 24*k* of the middle body and the annular surface 26*t* of the bottom sub by means of seal means 120, 122 while seal means 124, 126 insure a fluid tight relation between the packing support 92 and the middle body 24. It should be noted that a suitable opening 24*s* is formed in the middle body 24 and is adapted to receive a suitably formed fill plug 128 as described more fully hereinbelow.

Figure 2C:
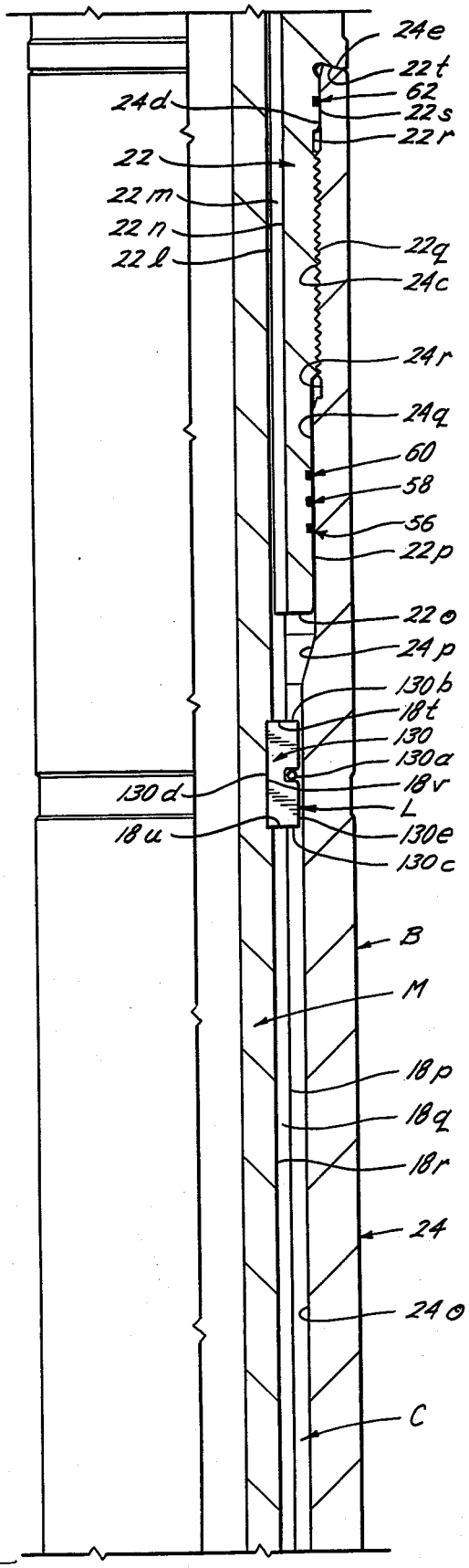
FIG. 2C is an elevational, sectional view of the shock absorber assembly of the present invention as taken along the lines 2C—2C of FIG. 1.
Figure 2D:
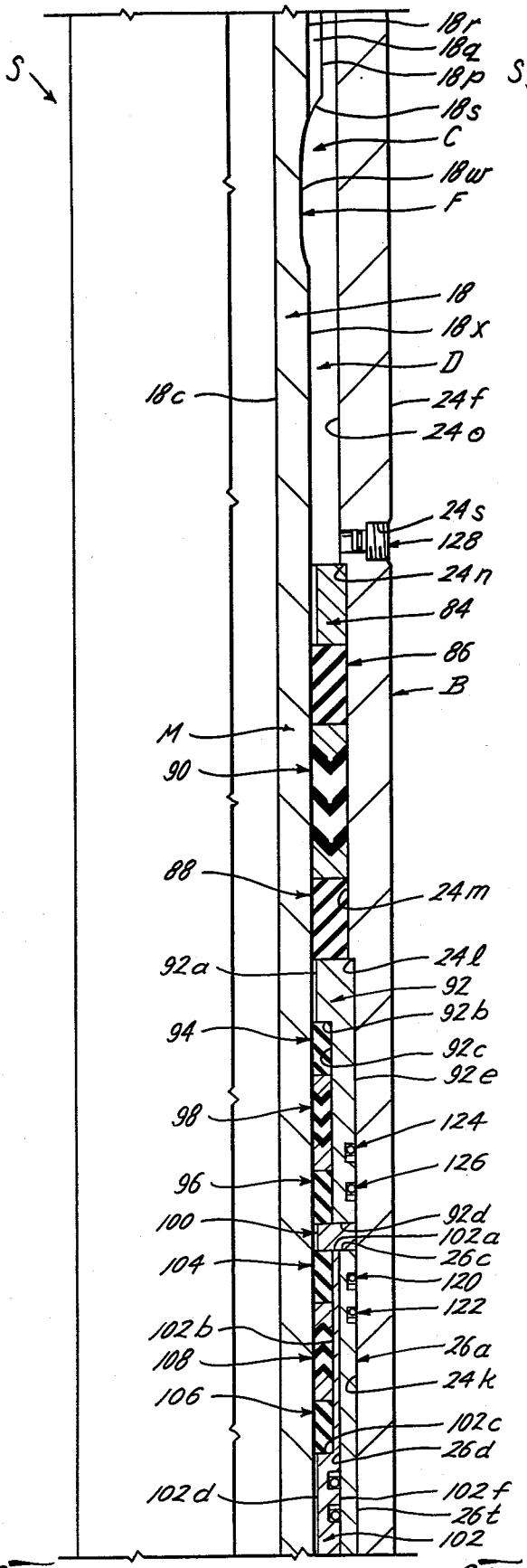
FIG. 2D is an elevational, sectional view of the shock absorber assembly of the present invention as taken along the lines 2D—2D of FIG. 1; and, FIG. 2E is an elevational, sectional view of the shock absorber assembly of the present invention as taken along the lines 2E—2E of FIG. 1.
Figure 2E:
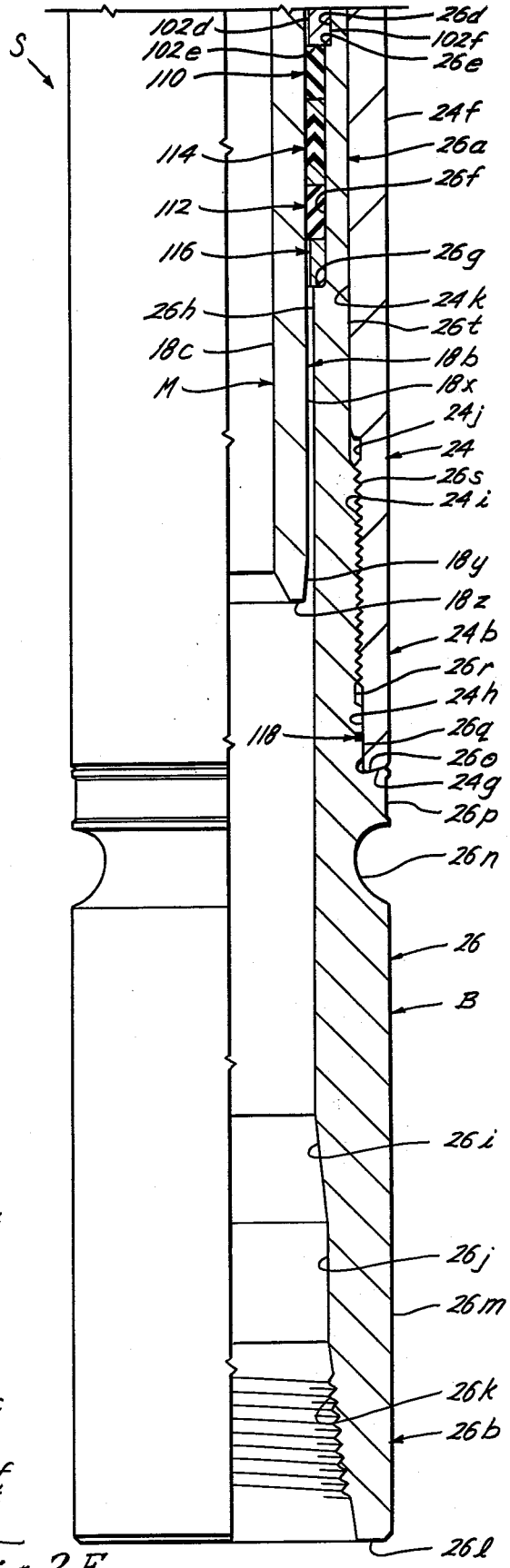

As best seen in FIG. 2C, a retaining ring 130 is mounted with the mandrel M between and adjacent to radial surfaces 18*t*, 18*u* and annular surface 18*v*. Preferably, the retaining ring 130 is of multiple segments all of which are secured with the mandrel 18 by means of snap ring 130*a*, which insures proper mounting of the segments of the retaining ring 130 within the constraints of the radial surfaces 18*t*, 18*u* and annular surface 18*b*. Preferably, the retaining ring 130 has an upper end surface 130*b* and a lower end surface 130*c* with an inner annular surface 130*d* and an outer annular surface 130*e*. As illustrated, the inner annular surface 130*d* engages annular surface 18*v* while lower end surface 130*c* engages radial surface 18*u* and upper end surface 130*b* engages radial surface 18*t*. The snap ring 130*a* is preferably mounted in a suitable detent formed with the outer annular surface 130*e*. Preferably, the outer annular surface 130*e* is of a diameter slightly smaller than that of the annular surface 24*o* of the middle body 24. Preferably, a suitable drill bit 12 is threadedly received by threads 26*k* of the bottom sub 26 in the use of the shock absorber assembly S of the present invention. However, as noted above the shock absorber assembly may be utilized at any intermediate position within the drill string 10 as is desired.

The shock absorber assembly S of the present invention further includes dampening means D which includes generally an annular chamber C and flex means F. The dampening means D is for dampening the intermittent shocks and vibrational forces encounted by using the shock absorber assembly S of the present invention in typical drilling operations.

The annular chamber C is generally defined as having an upper end limited generally by packing retainer 82 and a lower end limited by middle body packing retainer 84. The inner annular surfaces of the annular chamber C include (from top to bottom) surfaces 18*n*, 18*o*, 18*p*, 18*r* (FIG. 2B, 2C), 18*w*, 18*x* (FIG. 2D) with an outer annular surfaces of the annular chamber C being defined by (from top to bottom) annular surface 22*j*, surface 22*k*, surfaces 22*l*, 22*n*, 22*o*, 24*q*, 24*p*, 24*o* and terminating at the middle body packing retainer 84. It should be appreciated that there is an appropriate fill plug 64 adjacent the upper end of the annular chamber C and a fill plug 128 adjacent the lower end of the annular chamber C. As such, the annular chamber C is adapted to receive and be filled with a suitable compressible fluid, such as silicon oil. As such, as the drill bit 12 encounters intermittent shock and vibrational forces as it drills through the various geological formations 16, such vibrations and forces are transmitted from the bit 12 to the body B which is adapted to move in a longitudinal, reciprocal fashion with respect to the mandrel M. As such, the splines 18*q*, 22*n* permit the reciprocal action while preventing rotation between the mandrel M and body B. Longitudinal movement of the body B with respect to the mandrel M results in a variation in the volume of the annular chamber C. It should be noted that there is differential area due primarily to that of differences in diameters between that of the annular surface 18*n* (FIG. 2B) and that of annular surface 18*x* (FIG. 2D). With the variation in the diameters between such annular surfaces 18*n*, 18*x*, any longitudinal movement results in variable compression of the compressible fluid filled within the annular chamber C. The fill plugs 64, 128 permit filling the annular chamber C with a suitable compressible fluid while also permitting the purging of any trapped unwanted fluids such as water, air and the like. Upon filling the annular chamber C with the suitable compressible fluid, the shock absorber assembly S of the present invention is adapted to be ready for use.

The dampening means D further includes flex means F with the mandrel M adjacent the annular chamber C for permitting flexure of the mandrel M as needed for dampening. Specifically, the flex means is best seen as shown in FIG. 2D as noted in the area adjacent to shaped surface 18s and annular detent 18w. It should be noted that the wall thickness between the bore 18c and detent 18w is less than that of the thickness between annular surface 18x and bore 18c or surfaces 18r, 18c. As such, because of the reduced wall thickness adjacent surface 18w, the mandrel 18 of the mandrel M is subject to flexure upon a buildup of significant pressures within the annular chamber C. The rate of flexure of the flex means F is dependent upon the specifics of the material selected for the mandrel M and the wall thickness of the mandrel 18 adjacent to the surface 18w. A thinner wall section permits greater flexure while a thicker wall section results in a mandrel M more resistent to flexure.

As such, when the shock absorber assembly S of the present invention encounters the intermittent shocks and vibrational forces that it is intended to dampen out, the dampening means D includes not only the compressibility of the fluid within the annular chamber C but also flexure of the flex means F. As compression of the fluid within the annular chamber C increases, the mandrel M tends to collapse, balloon, or flex into the bore 18c adjacent to surface 18w. As shown in FIG. 2D the increase in pressure tends to force or cause the mandrel M to respond to the pressure by expanding into the bore 18c.

As a result, the shock absorber assembly S of the present invention permits a greater fluid volume to result in greater shock resiliency as compared with shock absorber assemblies not having the flex means F of the present invention. As a result, the dampening of the dampening means D is a combined value of the compressibility of the fluid within the annular chamber C in combination with the spring rate of the steel used to form the mandrel M thereof. As a result thereof, the flexure of the steel or other material of the mandrel M permits a greater stroke with a lower spring rate as the fluid in the annular chamber C is compressed and the steel or other material of the mandrel M is stretched or ballooned in response to the increased pressures within the annular chamber C. The flex means F will respond typically to pressures in excess of 20,000 psi as the metal starts to resiliently yield in response to the high pressures encountered within the annular chamber C upon encountering such intermittent shocks and vibrational forces. Furthermore, the compressible fluid acts upon the differential area noted hereinabove in its compression within the annular chamber C.

It should be noted that the retaining ring 130 results in an abuttment of the upper end surface 130b with lower end surface 22o when the shock absorber assembly S is in a fully extended, tension position which acts as a limiting means L for limiting movement of the mandrel M between its fully extended and fully contracted position with respect to the body B. It should be noted that the retaining ring 130 is within the annular chamber C and is surrounded by compressible fluid.

Furthermore, the mandrel body bearings 40, 42 are located near the upper end of the body B and help to prevent lateral displacement, wallowing or misaligned drilling of the shock absorber assembly S when used with the drill string 10. Prior art devices have included such bearing adjacent the lowermost portion of the tool (as shown by bearing 50 of U.S. Pat. No. 3,225,566 by way of example) which tend to result in such wallowing or misaligned drilling by using such a bearing mounted at the lower end rather than the orientation of the bearing as illustrated in the shock absorber assembly S of the present invention. Furthermore, it should be noted that with the lower end of the mandrel 18b oriented as illustrated, the bearings 110, 112 and packing set 114 along with bore 26h are protected from damage contaminate, as distinguished from the seal arrangement noted in U.S. Pat. No. 3,225,566 wherein the seal is placed adjacent the upper end of the mandrel causing a tendency for collecting abrasive particles adjacent thereto which may cause premature seal failures and damage to the seal bores.

Thus, the shock absorber assembly S of the present invention provides a new and improved assembly for use with the drill string 10 capable of absorbing intermittent shocks and vibrational forces encounted in such drilling operations whereby such shocks and forces cause the dampening means D to result in the compression of compressible fluid within the annular chamber C and flexure of the flex means F to effectuate the dampening thereof.

The foregoing disclosure and description of the invention are illustrative and explanatory thereof, and various changes in the size, shape and materials, as well as in the details of the illustrated construction may be made without departing from the spirit of the invention.

We claim:

1. A shock absorber assembly adapted to be used with a drill string for dampening intermittant shocks and vibrational forces encountered with the drill string during drilling operations, comprising:

a mandrel having a mandrel bore adapted to be mounted with the lower end of the drill string;

an elongated tubular body having an open upper end for receiving said mandrel therein, said elongated tubular body mounted for longitudinal reciprocal movement with respect to said mandrel;

dampening means including an annular chamber and flex means for dampening the intermittant shocks and vibrational forces;

said annular chamber formed between said mandrel and said elongated tubular body;

said flex means being an impervious wall forming a part of said mandrel adjacent said annular chamber for inward flexing of said impervious wall toward said mandrel bore of said mandrel; and, said annular chamber adapted to be filled with a compressible fluid whereby the intermittant shock and vibrational forces on said mandrel cause compression of said compressible fluid within said annular chamber whereby said compressed fluid exerts a uniform force within said annular chamber along the substantial length of said flex means thereby causing flexure of said flex means to effectuate the dampening of the intermittant shock and vibrational forces encountered with the drill string.

2. The shock absorber assembly of claim 1, wherein said dampening means includes:

said mandrel having an outer annular surface forming an inner portion of said annular chamber; and, said flex means includes an annular detent formed in said outer annular surface of said mandrel.

3. The shock absorber assembly of claim 1, wherein:

said annular chamber is formed having a differential volume.

4. The shock absorber assembly of claim 3, wherein:

said elongated tubular body has an inner bore;

said mandrel has an upper outer annular surface and lower outer annular surface, with the diameter of said upper outer annular surface being greater than the diameter of said lower outer annular surface;

said inner bore and portion of said upper and lower outer annular surfaces forming said annular chamber having said differential volume, whereupon longitudinal reciprocal movements between said body and said mandrel result in a variable compression of said compressible fluid in said annular chamber substantially caused by said differential volume in said chamber.

5. The shock absorber assembly of claim 1, further comprising:

bearing means mounted between and adjacent the said open upper end of said tubular body and said mandrel for preventing unwanted lateral displacement during drilling operations.

6. The shock absorber assembly of claim 1, further including:

limiting means mounted with said mandrel within said annular chamber for limiting movement of said mandrel between a fully extended and fully contracted position of said mandrel with respect to said elongated tubular body.

7. The shock absorber assembly of claim 1, wherein:

the smallest diameter portion of said mandrel is positioned adjacent the lower portion of said elongated tubular body.

* * * * *